United States Patent [19]

Clayton

[11] Patent Number: 4,832,985

[45] Date of Patent: May 23, 1989

[54] NEW COMPOSITION AND PROCESS FOR MECHANICAL PLATING AND THE RESULTING ARTICLE

[75] Inventor: Erith T. Clayton, Baltimore, Md.

[73] Assignee: Clayton Colleagues, Inc., Baltimore, Md.

[21] Appl. No.: 110,341

[22] Filed: Oct. 20, 1987

[51] Int. Cl.[4] ..... B05D 3/12

[52] U.S. Cl. ..... 427/242; 106/1.05

[58] Field of Search ..... 427/242; 106/1.05

[56] References Cited

U.S. PATENT DOCUMENTS

| | | | |
|---|---|---|---|
| Re. 23,861 | 8/1954 | Clayton | 117/109 |
| 2,640,001 | 5/1953 | Clayton | 117/109 |
| 2,689,808 | 9/1954 | Clayton | 117/131 |
| 2,723,204 | 11/1955 | Pottberg et al. | 117/24 |
| 3,023,127 | 2/1962 | Clayton | 117/109 |
| 3,093,501 | 6/1963 | Clayton | 427/242 |
| 3,132,043 | 5/1964 | Clayton | 117/109 |
| 3,251,711 | 5/1966 | Pottberg et al. | 117/109 |
| 3,443,985 | 5/1969 | Cutcliffe | 117/109 |
| 3,479,209 | 11/1969 | Clayton | 117/109 |

*Primary Examiner*—Sam Silverberg

*Attorney, Agent, or Firm*—Larson and Taylor

[57] ABSTRACT

A new composition for promoting mechanical plating, a process using the composition and the resulting article are disclosed. The new composition employs an acidic or alkaline flux and at least one silicone compound. When used in combination with a finely divided metal under mechanical plating conditions, exceptional metal coatings are produced. Also disclosed is the use of metal cleaning agents in the composition to further enhance the results obtained from the mechanical plating process. In addition, foaming agents may be used to generate a foam which aids in making the plating slurry transportable.

38 Claims, No Drawings

NEW COMPOSITION AND PROCESS FOR MECHANICAL PLATING AND THE RESULTING ARTICLE

BACKGROUND OF THE INVENTION

This invention relates to a mechanical plating process and a composition useful in such a mechanical plating process. More particularly, the invention relates to an improved mechanical plating process and composition of the type in which a tenaciously adherent metallic coating is applied on a surface of an object by subjecting metal particles to mechanical energy in a liquid medium to flatten and cold weld the metal particles to the object's surface and plate a continuous adherent metallic coating on the surface. Such mechanical plating processes are described in my earlier U.S. Pat. Nos. RE 23,861; 2,689,808; 2,640,002; 3,023,127; 3,132,043; 3,479,209; 4,202,915; and 4,293,584, which are hereby incorporated by reference.

The inventions disclosed in the foregoing launched a whole new field of plating which was new and unique in that it used mechanical energy to build up a coating instead of thermal or electrical energy. Thus, the mechanical plating process is distinct from electroplating techniques, hot dip plating techniques (e.g., galvanizing) and the like and also from paints, such as zinc rich paints, in which metal particles are adhered to a substrate by means of a paint binder. Over the years, mechanical plating has grown, and commercial plants, numbering in the hundreds, are operating in various countries around the world. In current commercial operations, objects to be coated, plating metal, promoter chemicals and impacting media (such as glass beads) are charged into multi-sided barrels which are rotated horizontally to produce coated objects by tumbling mechanical action within the barrel. The coating, typically 0.00025 inches thick, is satisfactory in all respects. However, using optimum equipment and formulations, a processing time of at least about 30 minutes is ordinarily required. Moreover, barrel plating is limited to the coating of objects small enough to fit within the rotating barrel. In general, therefore, barrel plating is limited to providing relatively thin coatings on relatively small objects and requires relatively long processing times. A more complete description of the mechanical barrel plating process is disclosed in my co-pending application Ser. No. 048,931 filed on May 12, 1987 which is hereby incorporated by reference.

For 30 years or more, mechanical plating has been done in rotating barrels and limited essentially to the same promoter system. The promoter system is the medium employed along with the metal powder to cause plating of the metal powder onto a surface as a result of the application of mechanical energy. The promoter system currently in use in mechanical barrel plating is typically an aqueous solution consisting of a sulfuric acid flux, a mixture of hydrocarbon filming agents or surfactants, and a defoaming agent. The pH of the promoter system is usually adjusted to between 1.2 and 2.0 at the beginning of each batch. In the barrel process the entire solution of promoter is discarded at the end of each batch so that all dissolved zinc salts and contaminants are discarded and as such, each batch begins with an entirely fresh solution of promoter.

It has become extremely desirable to adapt the process of mechanical plating to production of coatings outside of the barrel. However, the adaptation of the mechanical plating process to processes outside of the barrel created new problems which had not been of importance in the barrel plating process. For example, it became a difficult problem to transport the promoter solution and metal powders to the mechanical plating location. So far as is known, no attempt was made to make a promoter specially adapted for plating outside the barrel. Furthermore, the share of the market for barrel plating was further reduced by the inability to plate heavy coatings on very large pieces. Another problem with mechanical barrel plating was that the glass beads used as impact media had a tendency to break down into small pieces when impacted by heavy workpieces tumbling in the barrel. Each glass bead broken by impact created a large number of smaller glass fragments which increased the problem of transporting the zinc to the surface to be coated since the glass fragments made the plating mixture highly impermeable.

Two of my earlier patents, namely U.S. Pat. No. 4,202,915 and No. 4,293,584 related to mechanical plating processes done outside of the barrel. These processes merely adapted the promoter system used in mechanical barrel plating to the specific applications outside of the barrels. However, the use of the mechanical barrel plating promoter outside of the barrel created several new problems. For example, where the plating tool is a circular rotating brush with metal bristles, the tool exerts a very high degree of pressure on each individual wire bristle which, in combination with the hydrocarbon promoter system of the barrel plating process produces a very high polishing action, which creates an ultra-smooth, extremely shiny and lubricated surface. Employing the promoter of mechanical barrel plating such a surface cannot be further plated. This resulted in a limitation on the thickness of the coating to approximately 3.5 to 5 mils. This highly polished coating is known as a Bielby layer and has always been thought to be incapable of accepting a further adherent coating.

Another problem with the use of the mechanical barrel plating chemistry outside of the barrel is that the promoter system requires a pH between 1.0 and 3.0. Such a low pH of the promoter will corrode most equipment which comes in contact with the promoter. Thus, it is desirable to provide a promoter which does not have such an acidic pH and thereby minimizes corrosion problems associated with the equipment used for plating.

Alkaline systems were tried using using caustic soda, washing soda, bicarbonate of soda and an abrasive powder. An excellent quality coating was obtained. With this system it was possible to use a steel wire brush for the first time. There was no change in pH and the mix could be stored for weeks without deterioration. In commercial trials it was received enthusiastically.

It has long been thought that it is impossible to deposit a metallurgically integrated metallic coating on top of heat treat scale, mill scale, any metal surface which has not been cleaned down to the bare metal, or non-metallic surfaces. It does not matter whether the metallic coating is to be applied by hot-dip galvanizing, electroplating or metal cladding, for proper bonding to the substrate, it is thought that all heat treat scale must be completely removed. Usual methods include acid pickling, sand blasting, shot blasting and grit blasting. In all of these processes substantial quantities of the underlying substrate are removed, especially when it is necessary to clean out scale from holes or pits. This forms pollutant salts such as ferrous sulphate and also constitutes an important loss of the metal substrate.

Because of the high cost and difficulties associated with the scale removal on items such as structural steel the scale is usually left in place and covered with a zinc rich paint or frequently a red lead paint. The paint provides a barrier layer to fill in cracks in the scale to thereby provide corrosion protection. It is not comparable to solid metal protective coatings because the paints can be easily scratched or damaged. Substantial advantages would be gained by applying a very heavy zinc coating over scale which is tightly bonded to steel. This has always been considered impossible since it is thought that the scale must be removed prior to applying a coating.

SUMMARY OF THE INVENTION

The present invention relates primarily to promoter systems for use in all types of mechanical plating which are suitable for plating on metal surfaces, plating over scale, and plating onto some other non-metal surfaces as well.

The new promoter system is intended to replace systems which have lasted virtually without significant change for decades and were adapted primarily to mechanical barrel plating. The promoter system described in this specification includes acid systems, alkaline systems and dry mixes of promoter chemicals and metal powders to provide a free-flowing mix.

The new promoter disclosed herein is less expensive, more economical, more efficient and is designed to produce higher quality mechanically plated coatings which will be competitive with other coating systems such as hot-dip galvanizing and electroplating. This promoter system is designed to plate thicker coatings than have heretofore been possible with mechanical plating. This promoter will also plate thicker coatings than are possible with hot-dip galvanizing and thus will create entirely new products.

The new promoter also makes practicable a new and different kind of mechanical plating. It makes the high speed continuous plating process described in my U.S. Pat. No. 4,202,915 and the portable galvanizing as described in my U.S. Pat. No. 4,293,584 outmoded. U.S. Pat. No. 4,202,915 was a commercially viable process in itself. The problem was the difficulty of transporting the plating slurry since it plates on everything it touches when it is moved.

Another important advantage of the present invention is inclusion in the new promoter of foaming agents which can act as a transporter of the fine metal powders into contact with the article to be plated. The foaming agent creates a foam sufficiently fluid to transport the metal plating solution from one place to another and to penetrate into the plating tool or brush whereby the coating is plated very rapidly onto the substrate.

Therefore, it is an object of the present invention to provide a promoter system which is applicable to the plating of articles outside the barrel such as high speed plating of strip steel, the portable galvanizer, and other plating processes.

It is a further object of the present invention to provide a promoter system which is useful in the mechanical barrel plating process.

It is a further object of the present invention to provide a promoter system which makes it possible to plate metal coatings on top of heat treat scale and mill scale.

It is a still further object of the present invention to provide a promoter system which makes it possible to plate metal coatings over the previously unplatable Bielby layer and thus permit the application of coatings having a virtually unlimited thickness.

It is a still further object of the present invention to provide a promoter system which is capable of generating a foam which can act as a transporter of the fine metal particles to the mechanical plating surface.

It is yet a still further object of the present invention to provide a promoter system which may be tailor-made to permit a variety of of applications such as making the metal coating more abrasion resistant, more heat resistant, and more oxidation resistant.

These and other objects of the present invention will be apparent from the detailed description which follows.

DETAILED DESCRIPTION OF THE PREFERRED EMBODIMENTS

The invention relates primarily to a composition for use as a promoter system in a mechanical plating process the process using such promoter system and the resulting articles. A promoter is a composition which, when mixed with a metal powder, makes possible the mechanical plating of the metal powder onto a surface. Typically, the surface to be plated is immersed in a dispersion of metal powder in the promoter system (hereinafter referred to as the promoter). Then, mechanical energy is applied by a rotating barrel or by a rotating brush to a substrate in contact with the dispersion of metal powders in the promoter by a plating surface such as a wire brush to thereby cause plating of the metal powder onto the substrate to form a metal coating. Such mechanical plating conditions are characterized by the application of a sufficient amount of mechanical energy to cause the formation of a metal coating on the surface of the substrate in the presence of a dispersion of metal powders in the promoter.

The promoter systems may be an aqueous system, an organic system or an emulsion of an organic component in an aqueous system Each of these promoters is useful for specific applications of mechanical plating.

The promoter includes a flux which may be acid or alkaline. The purpose of the flux is to create a pH which is conducive to mechanical plating. The flux may also provide additional benefits in the form of cleaning the surface of the substrate or creation of a substantial foam for transport of the metal powders to the plating surface.

In the case of using an acid flux, which has been in use in mechanical barrel plating for many years, cheap acids such as sulfuric, citric and hydroxy-acetic acid among others, may be employed. The primary requirement of the acid flux is that it maintain the pH of the promoter between 1.2 and 2.0, which is the most preferable pH for mechanical plating. However, mechanical plating can be accomplished at pHs up to 3.5 and below 1.2 Although, at pH's above 2.0 the plating is relatively slow and thus less desirable. At pH's below 1.2 the plating is fast but the promoter becomes so harsh to its environment that containment of the promoter in the mechanical plating apparatus becomes a problem.

One problem which may be encountered with the acid flux is that the pH of the flux tends to increase during the plating process although this tendency can be slowed by the use of the new chemistry due to protection afforded by the use of silicones and other components in this new chemistry. This can be remedied by the addition of acid to the promoter during plating to maintain the pH in the desired range.

The present invention also provides an attractive alternative to the acid system. Instead, the promoter may employ an alkaline flux. The alkaline promoters have many advantages over the acid promoters. For instance, in arm solutions the acid constantly reacts with zinc or other metals to form salts and decompose the acid flux. This necessitates the constant introduction of fresh acid into the system and also creates undesirable salt impurities when done outside the barrel. In the barrel itself the solution is thrown away after each run so the problem does not exist. Further, the destruction of metal by the acid facilitates a significant waste of metal which may be economically undesirable. The acid system is very viable as is shown by more than 30 years of commercial use on a world wide basis.

The alkaline fluxes, on the other hand, generally do not react with metal. Thus, the alkaline flux generally maintains a constant pH since alkali is not being consumed by reaction. In addition, there is less wasted metal since the metal is not being consumed by reaction with the promoter. Finally, no undesirable salts are created by side reactions and thus impurities in the promoter are minimized.

When the alkaline flux is employed the pH of the promoter must be maintained above 9.0. Below 9.0 plating is too slow. There is no upper limitation on the pH as far as mechanical plating. However, the necessity of contacting the promoter with some type of plating equipment will normally require a pH between about 9.5 and 10.5.

Among the useful alkaline fluxes are sodium hydroxide, potassium hydroxide, sodium bicarbonate and washing soda and mixtures of these compounds. Usually an abrasive powder is included in the promoter. Conceivably, many other alkaline substances may be used as long as they provide a pH greater than 9.0, and do not interfere with the plating by reacting with metal or other components of the promoter. The alkaline fluxes have been found to plate faster than the old acid hydrocarbon systems. In addition, the products are more corrosion resistant, exhibit excellent ductility and formability and paints adhere extremely well to them. Paints adhere well to the acid system as well as when a compatable vehicle is used, especially one that bonds to the silicone ingredient in the promoter.

The principle ingredient of the promoter of the present invention is a silicone compound. Silicones have been used in mechanical plating in the past as anti-foaming agents. These anti-foaming silicones were used in small amounts to control the excessive foaming produced by the promoter in use at the time. Plant operators were prone to use excessive amounts to protect them from a rain of foam from overhead equipment. The amount of silicones added in substantial excess could stop plating. The presence of hydrocarbons in concentrations as high as one pound of hydrocarbon per gallon of promoter were responsible for metal plating. In fact, silicones used as anti-foaming agents had acquired a bad reputation in mechanical plating since addition of excess amounts of these silicones would stop plating entirely.

Research proved that silicones, when used in minor amounts, were remarkably effective in producing top quality coatings at a fraction of the cost of using the old hydrocarbon chemistry. The silicones are typically added to a promoter solution in amounts of 5 drops to 200 drops of silicones per 300 cc of aqueous sulfuric acid having a pH of 1.5. Several different mixtures of silicones are illustrated in examples 1–7. The amount of silicone necessary to cause mechanical plating will vary depending upon the type of silicones used in the promoter. The use of too large a quantity of silicones will stop plating entirely.

As far as is known, any silicone may be used in the present invention when using emulsions or water soluble silicones. When using, for example, Union Carbid's LE 45 with a viscosity of 1000 centistokes, extreme caution is needed. It is excess of this non-soluble type by as little as one or two drops in a small barrel plating 6 lbs of work to stop the plating. However, in many instances it will be desirable to employ foams to transport the metal powder to the plating site. In these instances, the silicones must be selected such that they are non-anti-foaming so that addition of foaming agents will create a substantial foam.

The silicones of the present invention are designed to replace the use of hydrocarbon film formers in the prior art. However, it is possible to use the silicones of the present invention in combination with the hydrocarbons of the prior art for specific applications, such as barrel plating. Thus, it may be desirable to employ minor amounts of hydrocarbons for selective applications along with the silicones of the present invention.

Among the especially useful silicones are the dimethyl polysiloxanes, alkyl polysiloxanes, the water soluble silicones and the water insoluble silicone emulsions. Often, a blend of viscosities is useful. In addition, it is often desirable to include one or more water insoluble silicones in the promoter. Among the many useful water insoluble silicones are those made by General Electric including SF 1147, SF 1188, SM 2162, and the SF 96 series. Other useful General Electric silicones are SF 1154 which is a polymethyl diphenyl siloxane fluid having outstanding heat resistance, Viscase™ and SF 1250 which is a chlorophenyl methyl siloxane. Another useful silicone is GE 1066 which is a hydrolytically stable polymethylsiloxane/polyethylene oxide/polypropylene oxide copolymer. This silicone is soluble in water, alcohols and some hydrocarbons and thus is useful in many different promoters.

Other useful silicones are those made by Union Carbide. All silicones made by Union Carbide appear to be useful in the present invention although some are more desirable than others. Among those which have been tested are a methyl polysiloxane fluid of the L.E. 45 series; the emulsions, particularly those used in automobile polishes such as L.E. 461, 462 and 463. The alkylene-oxide modified silicone fluid L 720 and L 7002 are also useful as well as reactive fluid L. 31 which is water repellent and available as an emulsion. R20, a sodium methyl silanate is particularly useful in the present invention since it is water repellant and resists staining. Reactive fluid emulsion LE 9300 is also water repellent.

Other silicones, such as the silicone resins which are dissolved in aromatic hydrocarbons, and the silicone silicates are useful and their use will be exemplified by the examples which follow.

One of the primary advantages of the use of silicones in the promoter of the present invention is that the coatings can be tailor-made to specific applications by varying the amounts and compositions of the silicones used in the promoter. The metal coatings mechanically applied to a substrate contain inclusions of the promoter. Thus, the properties of the metal coatings will be affected by the composition of the promoter since some of the promoter is embodied in the coating. This property of the mechanically applied coating is quite useful since the properties of the coatings can be varied by varying not only the metal but also by varying the composition of the promoter to impart desirable properties to the final metal coating. In addition, a coating of pure silicone can also be applied to a surface.

One of the most useful properties which can be imparted by changing the composition of the silicones is water repellency. The use of an hydrophobic silicone in the promoter will make the resultant coating water repellent. In a salt water environment water repellents will have the effect of decreasing the contact between the coating and the highly corrosive salt water to slow the rate of corrosion. Among other properties which have been varied by changing the silicones are the heat resistance, the stain resistance and the outward appearance of the coating.

In addition to the foregoing advantages, the use of silicones in the promoter is highly desirable since it acts as a lubricant during the plating process. Due to the contact between the plating surface with the substrates a large amount of energy is wasted due to frictional losses. Thus, the inclusion of silicones in the promoter serves to lubricate the contact area between the plating surface and the substrate to thereby reduce the friction and allow a substantial increase in the speed of movement of the plating surface with an overall energy reduction.

Mechanical plating can be accomplished by using a promoter containing an acid or alkali flux, a sufficient amount of silicones to cause metal plating and a metal powder in the processes of U.S. Pat. Nos. 4,202,915 and 4,293,584. No additional ingredients are necessary to effectuate mechanical plating. However, in specific situations it will be desirable to alter the properties of the promoter system by adding other ingredients thereto.

The promoter of the present invention including flux and silicones is mixed with a metal powder to form the plating solution. Another method of formulating the promoter of the present invention is to mix metal powder and powdered silicones together and ship this to the plating site. At the plating site the consumer has the option of mixing the metal and silicone powders with a flux or the consumer can feed the powdered silicones and metal directly to the plating substrate which is in contact with a flux and a solvent. The flexibility of mixing conditions herein described allow for a number of methods of formulating the promoter of the present invention. Particularly, the use of the dry powder mixture of silicones and metal powders may be highly desirable in the high speed plating of steel strip as described in U.S. Pat. No. 4,202,915 where it is necessary to feed a large quantity of promoter and metal to the plating site in a short amount of time. Because powders are free flowing they are easily moved to the plating site at high speed and thus the problem of transporting the promoter and metal to the plating site is minimized. For example, steel strip moving at high speed may be sprayed with the flux and silicones and then the metal dust may be sprayed as a dry powder onto the previously applied liquid promoter. Another system of transport is to incorporate the small amount of silicone required into the metal powder in dry form. The result is the appropriate amount of silicones incorporated into what for all practical purposes is a dry metal powder since there is so little silicone. This can be easily handled as a ready-to-use powder to be mixed with a liquid plating slurry.

Since it is desirable to have silicone inclusions in the coating, the present invention also encompasses the use of a powerful metal cleaning agent which acts as a potent film remover, de-greaser and de-oiler. Thus, contrary to the prior art teachings in mechanical barrel plating, the promoter system of the present invention leaves a film-free surface that may subsequently be plated by a coating having silicone inclusions. The film-free surface is more surface active than the surfaces of the prior art such that it will continue to accept additional metal coatings over previously unplateable, highly-polished Bielby layers. While I do not wish to be limited in any way, particularly useful metal cleaning agents include the ethoxylated dodecyl thio ether mercaptans and the ethoxylated tridecyl thio ether mercaptans. The use of these or similar agents produces revolutionary improvements in the art of mechanical plating.

Once the plating process is moved outside of the barrel, the promoter and metal powders must be transported to the plating site. Any movement and pressure applied to the metal powder/promoter slurry will cause it to plate on metal surfaces. Therefore, the metal powder/promoter slurry cannot be pumped because it will plate a metal pump solid with metal in a few minutes. This solid metallic mass is virtually impossible to remove without melting or dissolving it in a strong acid. Similarly, attempts to move the metal powder/promoter slurry through an auger-type apparatus using a metal helix operating in a steel pipe were unsuccessful since the auger-type apparatus froze solid after a few minutes of operation.

In order to move the metal powder/promoter slurry ideally, it should transport itself carrying the metal powder in dispersion. The slurry should not be contacted with metal surfaces until it reaches the plating site. Thus any equipment designed to transport the slurry should have a liner of some sort upon which the metal powder will not plate. Polyethylene and neoprene liners are useful for this purpose.

The present invention disregards this teaching and incorporates a foaming agent into the promoter. The heavy foam created by the foaming agent aids in dispersing the metal powder throughout the promoter/-metal powder slurry and makes the slurry transportable by significantly reducing its viscosity. While I have no desire to be limited to any one class of foaming agents it has been found that, among others, foaming agents used in bubble baths and shampoos are particularly suitable for the present invention and can carry an extremely heavy load of metal powder/promoter slurry. More particularly, the foaming agents can be selected from alkylsulphates, sodium octyl sulphate, sodium oleyl sulphate, alkylether sulphates, alcohol ethoxylate, betaines, cetyl alcohol, stauryl alcohol, and the metal cleaning agents previously mentioned can also act as foaming agents when used in the acid promoter system and the alkaline system. Cationic and anionic foaming agents may also be used in some cases but the preferred foaming agents are nonionics.

In some applications it may be necessary to use a dry powdered foaming agent such as sodium $C_{14-16}$ olefin sulfonate. This dry powder is often used in dry shampoos as well as bubble baths.

Due to the substantial reduction in viscosity which results from the addition of a foaming agent to the metal powder/promoter slurry, it is often necessary to incorporate an additional thickening agent or gelling solution to maintain the viscosity at an acceptable level. The viscosity should be maintained high enough such that the metal powder/promoter slurry includes a highly concentrated amount of metal powder. Useful thickening agents are known in the art and include hydroxyethyl cellulose in any one of a variety of grades. The materials having pseudo-plastic properties are particularly desirable since under conditions of high shear stress the foam will become very thick and durable and continue to increase its height and when the shear forces are removed, the foam will collapse. This is advantageous because it provides a means of elevating or lowering the foam level to a desired height. Thus, the foam can act as a pump and controlled by application of shear stress.

A major advantage of foam transportation is the ability of a suitable foam to hold all of the metal powder within the foam itself without leaving metal powder around the edges of a container or allowing it to escape from the system. In addition, the foam provides an excellent dispersion of the metal powders and other ingredients included in the metal powder/promoter slurry.

Tests have shown that the present invention makes it possible to plate over heavy heat treat scale with excellent adhesion and in addition, the coating can be built up to any desired thickness such as, for example, 7, 8, 10 or even 15 mils. This provides an impermeable coating of protective zinc that would be expected to last for an extremely long time. In addition, a paint coating could be applied over the top of this to add further protection. The plating over heat treat scale was accomplished with the portable galvanizer as described in U.S. Pat. No. 4,293,594. The plating over scale was done successfully with a hand-held steel wire bristle brush attached to an electric drill and zinc coatings plated over the scale were in excess of 10 mils and of exceptional quality. The bond of the zinc coating to the scale was so good that upon bending of a flat steel plate, the scale cracked off the steel, but the zinc continued to bond to the scale. On structural steels bending of the steel does not occur so that the zinc to scale bond will be sufficient to retain the zinc on the surface of the steel.

The corrosion problem caused by the presence of scale on the surface of the steel can be further reduced by first applying a coating of, for example, spar varnish or Krylon TM clear spray. After thorough drying, the zinc coating can then be applied. This illustrates that plating is possible onto non-metallic surfaces such as spar varnish, Krylon TM clear spray or even scale, which is an oxide layer. Plating of wood with aluminum has also been accomplished using the dry form of the process and by first painting the wood with a sodium silicate. Clearly, the promoter of the present invention has the potential to create new products previously not thought possible.

The following examples are provided to illustrate several embodiments of the present invention.

EXAMPLES 1-7

Set forth below in the following table are 7 examples of silicone fluid mixtures employed in liquid baths in accordance with the present invention. The individual silicone fluids included in the mixtures are defined in the table as A-G, and more details about each such silicone fluid are set forth below. The amount of a particular silicone fluid in a given silicone fluid mixture is expressed in drops. There are 20 drops per cc. The 7 silicone fluid mixtures are numbered 1 through 7.

| Silicone Fluid | Drops | | | | | | |
|---|---|---|---|---|---|---|---|
| | 1 | 2 | 3 | 4 | 5 | 6 | 7 |
| A | 3 | | | 5 | | | |
| B | 3 | | | | | 100 | |
| C | 6 | | | | | | |
| D | | 12 | 12 | 12 | | 12 | |
| E | | 2 | | | | | |
| F | | | 6 | 6 | | 6 | 6 |
| G | | | | | 12 | | 12 |

Except for Example No. 1, each of the 7 silicone fluid mixtures was employed in a liquid bath composition containing 300 cc of aqueous sulfuric acid having a pH of 1.5. Example No. 1 was employed with an aqueous sulfuric acid composition prepared from 5 cc of sulfuric acid, 66° (Baume), mixed with 300 cc of water to produce an aqueous sulfuric acid solution having a pH of 1.2. All of the liquid bath compositions which include the silicone fluid mixtures reflected by Examples 1-7 are proportioned for use with 50 gram of zinc powder.

Silicone fluid A is a silicone fluid emulsion containing 50 wt. % silicone and is available from General Electric under the name SM 2162.

Silicone fluid B is a dimethylpolysiloxane emulsion containing 35 Wt. % silicone and having a viscosity of 45 centistokes (cs). This silicone fluid emulsion is available from Union Carbide under the name LE 45.

Silicone fluid C is a dimethylpolysiloxane fluid that is not emulsified. It is completely insoluble in water, and it has a viscosity of 45 cs.

Silicone fluid D is a blend of high and low viscosity dimethylpolysiloxane fluid emulsions and contains 35 wt. % silicone. It is a medium viscosity emulsion and is available from Union Carbide under the name LE 463.

Silicone fluid E is a dimethyalkylpolysiloxane having a viscosity of 50 cs combined with a chlorophenylmethylpolysiloxane lubricating fluid. Silicone fluid E is water insoluble and is available from General Electric under the name Versilube(tm) Plus SF 1147.

Silicone fluid F is a water insoluble, intermediate viscosity dimethylpolysiloxane fluid available from Union Carbide under the name L-45-1000 and is a very powerful lubricant which substantially reduces drag of the brush and prevents welding of the brush to the plate.

Silicone fluid G is a reactive dimethylpolysiloxane fluid emulsion which has strong water repellency. It has a viscosity of 8,000 cs and is available from Union Carbide under the name LE-9300 Emulsion.

A liquid bath composition employing a silicone fluid mixture as in Example 1 was used to mechanically plate zinc on a steel strip, in accordance with the present invention. The liquid bath composition was heated to a temperature of 71° C. (160° F.), and the coating was formed by brushing the steel strip with a rotating disc-shaped brush having brass bristles, and utilizing a pressure on the brush of about 60 pounds. The resulting zinc coating on the steel strip was smooth and highly polished with a very good gloss. The coating passed a standard bend test (OT) as well as all standard impact tests and the standard tape test employed for testing zinc coating on steel strip. Paint would not adhere to the coating.

Paint will adhere to the zinc coating when employing a liquid bath composition containing silicone fluid mixture in accordance with Example 2. The processing conditions were essentially the same as discussed in the preceding paragraph in connection with Example 1, except that the bath had a temperature of 60° C. (150° F). Standard automotive paints adhered well to the resulting zinc coating, and the painted surface passed the standard bend tests (0-T to 4-T) without any failure as well as the standard tape tests and standard impact tests. The coating phosphated well. Spot welding results were very satisfactory, and salt spray test results were fully equal to electrogalvanized steel. The zinc coating was very smooth and lustrous and had a thickness expressed as G-90 on a standard commercial scale (13.7–34.3 microns or 0.54–1.35 mils).

The zinc coatings made with compositions containing silicone fluid mixtures in accordance with Examples 3–7 performed well on all the tests described above in connection with Examples 2, except that the O-T bend test was not performed on the coating utilizing Example 6. Example 6 produced an especially heavy coating which was very smooth and shiny. Example 7 also produced a coating which was particularly smooth and shiny.

In general, zinc coatings applied in accordance with the present invention produced test results in all aspects equal to or superior to those produced by coatings made with conventional hot dip or electrogalvanizing procedures. With respect to the adherence of the mechanically deposited zinc coating on the steel strip, in dome tests the coating remained adherent up to the point of fracture of the steel. With respect to formability, in a series of bend tests over diameters equal to 0, 1, 2, 3 and 4 times the coated strip thickness (i.e., 0T-4T bend tests), there was no apparent fracture or flaking of the zinc coating. Typically the coating had a thickness of 0.5 mil in these tests.

A steel strip mechanically coated with zinc in accordance with the present invention has paintability comparable to conventional hot dip or electrogalvanized steel, and its welding characteristics are comparable to electrogalvanized steel.

With respect to corrosion resistance, a mechanically coated strip in accordance with the present invention is indistinguishable from an electrogalvanized steel strip having a coating of equivalent thickness when the strips undergoing comparison have been coated with a typical automotive paint finish. When subjected to a salt fog test, the resistance of the paint to blistering or lifting from the surface is equivalent for the mechanically coated strip and the electrogalvanized steel strip.

A mechanically coated steel strip prepared in accordance with the present invention has a coating appearance which is superior to that of electrogalvanized or hot dip galvanized steel strip, from the standpoints of smoothness and lustre. Both the coatings have equivalent uniformity.

The formability and paintability of a zinc coating produced in accordance with the present invention and the tenacity of adherence of the paint layer are superior to those resulting when the coating is mechanically applied in a process employing a hydrocarbon promoter of the prior art.

COMPARATIVE EXAMPLE 8

In a pilot research unit 8-inch wide steel strip was run in a closed loop through a plating slurry bath containing the hydrocarbon plating slurry of the prior art and a dilute solution of sulfuric acid acting as a flux. The solution was heated to a temperature of 125° F. and a single brush rotating at high speed having a circular ring of brass wire bristles around a center was used as the plating tool. The brush was urged against the moving strip and plating slurry was fed to the brush through a metal auger working in a steel pipe. The metal used for plating was zinc dust with a particle size of approximately 4 to 15 microns. This process is outlined in U.S. Pat. No. 4,202,915. The pH was maintained between 1.2 and 2.0. The combination of the warm plating solution of sulfuric acid and hydrocarbons produced an unacceptably high loss of zinc and acid. In addition, special equipment was required to house the highly acidic plating solution.

The use of the all silicone chemistry of the present invention produced immediate benefits. Plating speeds were increased by a factor of up to four times. The greater lubricity of the silicone substantially reduced drag and thereby reduced the amount of horsepower necessary to pull the strip in the loop around the system and to power the rotation of the plating brush. The use of silicones reduced the acid and zinc loss to acceptable limits making an acid flux acceptable. In particular, a silicone silicate dissolved in an aqueous solution of ethylene glycol added to the promoter doubled the plating rate over that achieved previously.

EXAMPLE 9

This example employs alkali promoter K.A. 15 used extensively in an experimental pilot line for high speed plating of a steel strip of 8-inch wide mill steel. The plating tool was a motor driven rotating steel wire brush the following composition constitutes K.A. 15 formula:

1000 ccs of water
160 grams of bicarbonate of soda
15 ccs of Union Carbide silicone emulsion L.E. 463
3 ccs of General Electric Silicone SF 1147
4 ccs of Union Carbide Silicone L-45-1000.

This L-45-1000 is water insoluble, is not emulsified, is a very powerful filming agent, and lubricant, and provides lubrication to reduce the horsepower of the motor driving the plating tool.

The temperature of the operating bath was maintained at 120° F.

The following conclusions were made after weeks of testing in which the same solution was used and reused again and again.

1. The pH is permanent—no loss of flux. Necessary to add water each day to replace evaporation.
2. The flocs are much smaller and harder than those in the acid system.
3. The plating is faster than in the acid system.
4. The steel wire brushes acquire a self-renewing zinc coating on the bristle tips such that no wear on the brushes occurs.
5. The coating is smooth and continuous, but not as shiny as in the acid system.
6. It is not necessary to use stainless steel or other acid proof equipment.

7. Zinc coatings made by the alkali coating solutions take hours longer to dissolve off the substrate in the presence of an acid pickling solution than is the case with zinc coating of the same thickness made by the acid coating solutions.

EXAMPLE 10

A particular silicone promoter was extensively used in an acid plating system in experimental pilot line plating of 8-inch wide strip.

Formula 300 ccs of water
12 drops of L.E. 463
3 ccs of sulfuric acid
4 drops of General Electric Silicone S.F. 1250 (Chlorophenyl methyl siloxane)
15 drops of silicone silicate dissolved in ethylene glycol.

The coating was very heavy and uniform for a substantial number of runs.

EXAMPLE 11

The same chemistry as described in Example 10 was used to plate wire. These wires were rotated during plating. The wire first was degreased and was fed int a slurry as described in Example 10 with Federated #11 zinc dust. In a similar test, two wires were fed through two brushes mounted on the same shaft with the bristles facing each other and almost touching. The brushes were immersed in plating slurry as in Example 10 and the wires were pulled by a motor through the brushes and a very highly polished zinc coating on the wires was achieved.

EXAMPLE 12

This example illustrates that the ethoxylated mercaptans are not effective when used alone. They become extraordinarily effective when they are used in admixture with the silicones. The structure of the ethoxylated mercaptans is represented by the following formula:

$$C_{12}H_{25}S(CH_2CH_2O)_xH$$

where $x$= number of moles of ethylene oxide.

A stock solution of 100 grams of ethoxylated thioether mercaptan (where X is 12), and 150 grams of sulfuric acid (66° Baume) were mixed with water to make one quart. Fifty ccs of the above solution were added to 300 ccs of water. Four separate tests were made.

Test 1. The coating became very shiny and very smooth. The coating thickness was not uniform. This test was prepared 3 times with the same results.

It is important that in all of these 4 tests, the coating did not build in thickness.

To the above mix was added 5 drops of silicone silicate in an ethylene glycol solution and 5 drops of Union Carbide LE 463. The result: the coating built up very fast and became very uniform. The build-uprose to 5 mils and the coating became very highly polished—sufficiently so that it was possible to see one's face in the coating. What was remarkable was that the coating continued to build on such a highly polished surface. This mixture produced its own substantial foam due to the presence of the zinc, acid and metal cleaning agent and thus facilitated the transport of the metal powder/-promoter slurry.

The above results were confirmed in dozens of tests using a variety of different silicones as discussed in the specification. As noted in the specification, this combination of silicone and metal cleaning agent is equally effective in all forms of mechanical plating.

The foregoing detailed description of several embodiments of the present invention has been presented for purposes of illustration and description. It is not intended to be exhaustive or to limit the invention to the precise forms disclosed, and many modification and variations will be obvious to one of ordinary skill in the art in light of the above teachings. Accordingly, the scope of the invention is to be defined by the claims appended hereto.

What is claimed is:

1. A composition for mechanical plating of metals onto a substrate comprising:

an aqueous solution including a flux selected from the group consisting of alkali fluxes producing a solution pH greater than 9.0 and acid fluxes producing a solution pH of from about 1.0 to about 3.5, a sufficient amount of at least one non-anti-foaming silicone compound to cause metals to plate onto a substrate under mechanical plating conditions, and a sufficient amount of at least one metal cleaning agent to enhance the plating of metals onto a substrate under mechanical plating conditions.

2. A composition as claimed in claim 1 wherein said flux is an alkali flux producing a solution pH greater than 9.0.

3. A composition as claimed in claim 1 wherein said flux is an acid flux producing a solution pH of from about 1.0 to about 3.5.

4. A composition as claimed in claim 1 wherein said at least one metal cleaning agent is selected from the group consisting of ethoxylated thioether mercaptans.

5. A composition as claimed in claim 4 further comprising a sufficient amount of at least one finely divided metal dispersed in said solution to coat the surface to be plated.

6. A composition as claimed in claim 1 wherein said at least one silicone compound is selected from the group consisting of polymethylalkylsiloxanes, polydimethylsiloxanes, polyphenylmethylsiloxanes, polychlorophenylsiloxanes, and silicone compound functional equivalents thereof, unmodified polysiloxanes, organomodified polysiloxanes and polysiloxane emulsions.

7. A composition as claimed in claim 1 further comprising an effective amount of at least one foaming agent to create a substantial foam.

8. A composition in accordance with claim 7 wherein said at least one silicone compound comprises at least one hydrophobic silicone compound.

9. A composition for the mechanical plating of metals onto a substrate comprising:

an aqueous solution including .

a flux selected from the group consisting of alkali fluxes producing a solution pH greater than 9.0 and acid fluxes producing a solution pH of from about 1.0 to about 3.5;

a sufficient amount of at least one silicone compound to cause metals to plate onto a substrate under mechanical plating conditions;

an effective amount of at least one foaming agent to produce a substantial foam, and a sufficient amount of at least one metal cleaning agent to enhance the plating of metals onto a substrate.

10. A composition as claimed in claim 9 wherein said at least one metal cleaning agent is selected from the group consisting of ethoxylated thioether mercaptans.

11. A composition as claimed in claim 9 wherein said at least one silicone compound comprises at least one hydrophobic silicone compound.

12. A composition as claimed in claim 9 wherein said at least one foaming agent comprises at least one foaming agent selected form the group consisting of alkyl sulphates, sodium octyl sulphate, sodium oleyl sulphate, alkyl ether sulphates, alcohol ethoxylate, betaines, cetyl alcohol and stauryl alcohol.

13. A composition as claimed in claim 10 further comprising a sufficient amount of at least one finely divided metal dispersed in said solution to coat the surface to be plated.

14. A composition which does not contain a hydrocarbon film-former and is for mechanical plating of metals onto a substrate comprising:

an aqueous solution including a flux selected from the group consisting of alkali fluxes producing a solution pH greater than 9.0 and acid fluxes producing a solution pH of from about 1.0 to 3.5;

a sufficient amount of at least on silicone compound to cause metals to plate onto a substrate under mechanical plating conditions, and a sufficient amount of at last one metal cleaning agent to enhance the plating of a metal onto a substrate.

15. A composition as claimed in claim 14 wherein said flux comprises an alkali flux which produces a solution pH greater than 9.0.

16. A composition as claimed in claim 15 wherein said at least one silicone compound comprises a non-anti-foaming silicone compound.

17. A composition as claimed in claim 16 wherein said at least one non-anti-foaming silicone compound comprises at least one hydrophobic silicone compound.

18. A composition as claimed in claim 16 further comprising an effective amount of at least one foaming agent capable of producing a substantial foam.

19. A composition as claimed in claim 18 wherein said at least one metal cleaning agent is selected from the group consisting of ethoxylated thioether mercaptans.

20. A composition as claimed in claim 14 wherein said flux comprises an acid flux which produces a solution pH of from about 1.0 to about 3.5.

21. A composition as claimed in claim 20 wherein said at least one silicone compound comprises a non-anti-foaming silicone compound.

22. A composition as claimed in claim 21 wherein said at least one non-anti-foaming silicone compound comprises at least one hydrophobic silicone compound.

23. A composition as claimed in claim 22 further comprising an effective amount of at least one foaming agent capable of producing a substantial foam.

24. A composition as claimed in claim 23 wherein said at least one metal cleaning agent is selected from the group consisting of ethoxylated thioether mercaptans.

25. A composition as claimed in claim 24 further comprising a sufficient amount of at least one finely divided metal dispersed in said solution to coat the surface to be plated.

26. A composition for mechanical plating of metal onto a substrate comprising:

an aqueous solution including a flux selected from the group consisting of alkali fluxes producing a solution pH greater than 9.0 and acid fluxes producing a solution pH of from about 1.0 to about 3.5;

a sufficient amount of at least one non-anti-foaming silicone compound to cause metals to plate onto a substrate under mechanical plating conditions, and a sufficient amount of at least one finely divided metal dispersed in said solution to coat the surface to be plated.

27. A composition as claimed in claim 26 further comprising a sufficient amount of at least one metal cleaning agent to enhance the plating of metals onto a substrate under mechanical plating conditions.

28. A composition which does not contain a hydrocarbon film-former and is for mechanical plating of metals onto a substrate comprising:

an aqueous solution including a flux selected from the group consisting of alkali fluxes producing a solution pH greater than 9.0 and acid fluxes producing a solution pH of from about 1.0 to about 3.5;

a sufficient amount of at least one silicone compound to cause metals to plate onto a substrate under mechanical plating conditions, and a sufficient amount of at least one finely divided metal dispersed in said solution to coat the surface to be plated.

29. A composition as claimed in claim 28 further comprising a sufficient amount of at least one metal cleaning agent to enhance the plating of metals onto a substrate under mechanical plating conditions.

30. A process for mechanically plating at least one metal onto a substrate comprising the step of:

applying mechanical energy to at least one finely-divided metal in contact with a substrate and a sufficient amount of a plating composition comprising an aqueous solution including a flux selected from the group consisting of alkali fluxes producing a solution pH greater than 9.0 and acid fluxes producing a solution pH of from about 1.0 to about 3.5, and a sufficient amount of at least one non-anti-foaming silicone compound to cause plating of the at least one metal onto the substrate.

31. A process in accordance with claim 30 wherein the plating composition further comprises a sufficient amount of at least one metal cleaning agent to enhance the plating of the at least one metal onto the substrate.

32. A process in accordance with claim 31 wherein the metal cleaning agent comprises at least one metal cleaning agent selected from the group consisting of ethoxylated thioether mercaptans.

33. A process for mechanically plating at least one metal onto a substrate comprising the step of:

applying mechanical energy to at least one finely-divided metal in contact with a substrate and a sufficient amount of a plating composition comprising an aqueous solution including a flux selected from the group consisting of alkali fluxes producing a solution pH greater than 9.0 and acid fluxes producing a solution pH of from about 1.0 to about 3.5; an effective amount of at least one foaming agent to produce a substantial foam, and a sufficient amount of at least one silicone compound to cause plating of the at least one metal onto the substrate.

34. A process in accordance with claim 33 wherein the plating composition further comprises a sufficient amount of at least one metal cleaning agent to enhance the plating of the at least one metal onto the substrate.

35. A process in accordance with claim 34 wherein the metal cleaning agent comprises at least one metal cleaning agent selected from the group consisting of ethoxylated thioether mercaptans.

36. A process for mechanically plating at least one metal onto a substrate comprising the step of:

applying mechanical energy to at least one finely-divided metal in contact with a substrate and a sufficient amount of a plating composition which does not contain a hydrocarbon film-former and comprises an aqueous solution including a flux selected from the group consisting of alkali fluxes producing a solution pH greater than 9.0 and acid fluxes producing a solution pH of from about 1.0 to about 3.5, and a sufficient amount of at least one silicone compound to cause plating of the at least one metal onto the substrate.

37. A process in accordance with claim 36 wherein the plating composition further comprises a sufficient amount of at least one metal cleaning agent to enhance the plating of metal onto the substrate.

38. A process in accordance with claim 37 wherein the silicone compound comprises at least one non-anti-foaming silicone compound and the metal cleaning agent comprises at least one metal cleaning agent selected from the group consisting of ethoxylated thioether mercaptans.

* * * * *